US006436016B1

(12) United States Patent
Valentino

(10) Patent No.: US 6,436,016 B1
(45) Date of Patent: Aug. 20, 2002

(54) DUMBBELL SUSPENSION SYSTEM

(76) Inventor: Anthony J. Valentino, 106 Norman St., W. Springfield, MA (US) 01089

( * ) Notice: Subject to any disclaimer, the term of this patent is extended or adjusted under 35 U.S.C. 154(b) by 33 days.

(21) Appl. No.: 09/663,627

(22) Filed: Sep. 18, 2000

Related U.S. Application Data

(60) Provisional application No. 60/214,822, filed on Jun. 28, 2000.

(51) Int. Cl.[7] ..... A63B 21/072

(52) U.S. Cl. ..... 482/108; 482/104

(58) Field of Search ..... 482/93, 94, 104, 482/106–108; D21/679–682

(56) References Cited

U.S. PATENT DOCUMENTS

| | | | | | |
|---|---|---|---|---|---|
| 742,393 | A | * | 10/1903 | Chellis et al. | 482/50 |
| 1,917,566 | A | * | 7/1933 | Wood | 482/108 |
| 4,216,959 | A | * | 8/1980 | Niles | 482/104 |
| 4,231,569 | A | * | 11/1980 | Rae | 482/108 |
| 4,253,662 | A | * | 3/1981 | Podolak | 482/104 |
| 4,605,222 | A | * | 8/1986 | Shannon | 482/106 |
| 4,607,840 | A | * | 8/1986 | Harper | 482/108 |
| 4,615,524 | A | * | 10/1986 | Sutherland | 482/104 |
| 4,627,618 | A | * | 12/1986 | Schwartz | 482/105 |
| 4,743,017 | A | * | 5/1988 | Jaeger | 482/108 |
| 4,768,780 | A | * | 9/1988 | Hayes | 482/108 |
| D297,962 | S | * | 10/1988 | Wu | D21/682 |
| 4,955,604 | A | * | 9/1990 | Pogue | 482/106 |
| D317,641 | S | * | 6/1991 | Gerard | D21/682 |
| 5,242,350 | A | * | 9/1993 | Chang | 482/105 |
| 5,325,997 | A | * | 7/1994 | Washington et al. | 482/108 |
| 5,393,285 | A | * | 2/1995 | Fischer et al. | 482/106 |
| 5,472,397 | A | * | 12/1995 | Ammoscato et al. | 482/104 |
| 5,573,484 | A | * | 11/1996 | Carpenter | 482/108 |
| 5,651,758 | A | * | 7/1997 | Cervantes | 482/93 |
| D383,815 | S | * | 9/1997 | Isaacson | D21/678 |
| 5,823,922 | A | * | 10/1998 | Eckmann | 482/105 |
| 5,971,339 | A | * | 10/1999 | Falasco, Jr. | 482/108 |
| D449,863 | S | * | 10/2001 | Kinde | D21/682 |

* cited by examiner

*Primary Examiner*—Jerome W. Donnelly
*Assistant Examiner*—Victor Hwang
(74) *Attorney, Agent, or Firm*—Deborah A. Basile; Kevin Vanderleeden

(57) ABSTRACT

Disclosed is a weight-lifting apparatus for use by bodybuilders and professional power lifters. The apparatus includes a specially designed dumbbell and dumbbell suspension hook. The dumbbell has ends to which weights may be added and removed to reach certain lifting weights. The dumbbell further has an attached handle from which the dumbbell may be suspended from the hook, which is located on a weight bench. The handle is U-shaped so as to work in unison with the specially designed J-shaped hook. The hook is designed to catch and hold the U-shaped handle, allowing it to drop down into the hook and to self-center the dumbbell at its equilibrium position. The dumbbells and suspension hooks are intended to be used together to eliminate the need for spotters, while optimizing safety.

7 Claims, 3 Drawing Sheets

DUMBBELL SUSPENSION SYSTEM

This application claims priority to provisional patent application No. 60/214,822, filed Jun. 28, 2000.

FIELD OF THE INVENTION

This invention relates generally to weight-lifting apparatus used by bodybuilders and professional power lifters. More particularly, the present invention comprises specially designed dumbbells with handles and specially designed hooks mounted on the bench on which the handles rest. These hooks attach to a weight bench and the dumbbells have mounted loops or handles which are suspended from the hooks on the bench. The hooks and dumbbells are designed to work together to optimize safety and to allow all lifters to exercise without a spotter.

BACKGROUND OF THE INVENTION

Hand-weights have long been used for exercise purposes. The types of exercises using hand-weights range from aerobics to body-building. The hand-weights for aerobics generally weigh only a couple of pounds, while the hand-weights for body-building are generally heavy weights of over a hundred pounds.

Weight training employs, among countless other techniques, the use of barbells and dumbbells. A barbell user, in bench-related exercises, has long had the advantage of being able to start his set from a secure position and rest or "rack" his weights onto a secure stand upon the completion of his set. Dumbbell users, on the other hand, often require the help of an additional partner, or spotter, to safely position the weights at the beginning of an exercise as well as to help safely return the weights to a rest position after the exercise.

The present invention provides specially designed hooks that are mounted on a weight bench for suspension of dumbbells having attached handles. The user simply releases the dumbbell over the hook to allow it to suspend by its attached handle from the hook on the weight bench. The user may lie on the bench and disengage the dumbbells by raising them from the hooks without a spotter. Following the user's work-out, the user may be exhausted and may have decreased control over his or her muscles. The user needs only to make contact between the U-shaped handle or loop of the dumbbell and the hook (contact may be made at any point on the U-shaped handle and at any point on the hook), drop the dumbbell at that point, and the hook will catch and hold the dumbbell and it will self-center to its equilibrium position.

The heavy-duty design and construction of the hooks and mounted loop dumbbells assure safety and security at the beginning and end of each exercise.

The invention focuses on heavy dumbbells for use in body-building exercises. Typically, these dumbbells are used in arm, shoulder and chest development exercises in which the lifter performs a small number of repetitions (generally about 10–15) while standing, sitting or lying down on a weight bench. Because of the heaviness of the dumbbells, a lifter's movements are limited. The lifter can perform his repetitions with or without a spotter, but either way, he faces problems of inconvenience, potential strain, and injury in releasing the dumbbells.

When a lifter does not use a spotter, he or she may strain and injure himself when he initially reaches for and lifts the dumbbells off the floor into his or her start position. This is especially so where the lifter performs his or her repetitions lying on his or her back on a weight bench, which is typically about 1–3 feet high. The lifter must lift the heavy dumbbells, which are positioned on the floor on each side of the weight bench, up to his or her start position. This causes tremendous strain and often leads to injury. Then, upon completing his or her repetitions, the lifter is usually too exhausted to guide the dumbbells back down and gently place them on the floor. Instead, the lifter will typically drop the dumbbells onto the ground. This may cause injury if a dumbbell bounces off the floor or rolls and hits another person.

In the event that a lifter has spotters available, the problems of injury and strain are substantially diminished. Ideally, two spotters pick the dumbbells up from the floor and hand them to the lifter in his start position. When the lifter completes his repetitions, each spotter must then grab a dumbbell from the lifter before he drops them to the floor. However, it is usually inconvenient and impracticable to have two, much less one, spotter available to stand by the lifter throughout his or her repetitions. The present invention allows the lifter to easily place the dumbbells in the hook without precision. In the event that the user still cannot place the dumbbell on the hook, he or she may place the dumbbell on the floor and it will not roll due to the loop on the handle.

The prior art includes both aerobic and body-building types of hand-weights. The aerobic hand weights found in the prior art are generally not used in conjunction with a weight bench. Rather, these hand weights are used, for example, while walking or jogging. Due to the nature in which these hand weights are used, the prior art in this area of hand weights has generally focused on making the hand weights easier to grip for long periods of time. This had been accomplished by developing hand weights with hand-engaging members. The hand-engaging member is a portion of the hand weight that extends over and molds to the back of the hand, thus engaging the hand between the hand-engaging member and the center gripping bar in a soft, frictional engagement. This concept is inherently different from the present invention because the present invention consists of a loop on the handle which is not malleable or adjustable and which does not fit snugly over the user's hand. The loop is a device for suspension of the dumbbell only.

Body-building dumbbells found in the prior art have not addressed the problems of inconvenience, strain or injury in initiating or completing a lifting session as described above. Rather, the prior art in this area generally involves basic designs of weighted ends either fixed to or removably mounted on a center gripping bar. None of the dumbbells contemplate an additional feature adapted to hang the dumbbell from a weight bench which is adapted to self-center the dumbbell at its equilibrium position.

The weight benches used with body-building weights found in the prior art are designed to hold weights. However, these benches do not have specially designed hooks, from which the dumbbells hang. They do not have hoods which when used with the looped handle of the dumbbell automatically center at their equilibrium position to avoid the need for the exact placement by the user. This ability is due to the design of the hooks and the loops on the handles.

What is needed, and hence, what would contribute to the state of the art, is weight-lifting apparatus that eliminates the need for spotters while decreasing the potential for injury and strain due to the absence of spotters.

SUMMARY OF THE INVENTION

I designed weight-lifting apparatus that includes dumbbells with looped, U-shaped handles and a dumbbell suspension hook for a weight bench. The dumbbells are designed to hang from the hooks mounted on a weight bench. This enables a lifter to position the dumbbells where he or she will have easy access to them from his or her start position and where he or she can safely and easily replace the dumbbells after completing his or her repetitions.

A main objective of this invention is to provide dumbbell users with a safe lifting device.

A further objective of this invention is to provide dumbbell users with a device that will eliminate the need for an assistant and provide the opportunity to exercise safely and independently at any level of expertise.

Another objective of this invention is to provide dumbbell users with a device that will suspend dumbbells from curved hooks attached to a weight bench.

A further objective of this invention is to provide dumbbell users with loop-handle dumbbells that provide ample hand clearance to avoid hand injury and which self-center to equilibrium when placed in contact at any part of the loop with the hook.

DETAILED DESCRIPTION OF THE DRAWINGS

Figure 1:
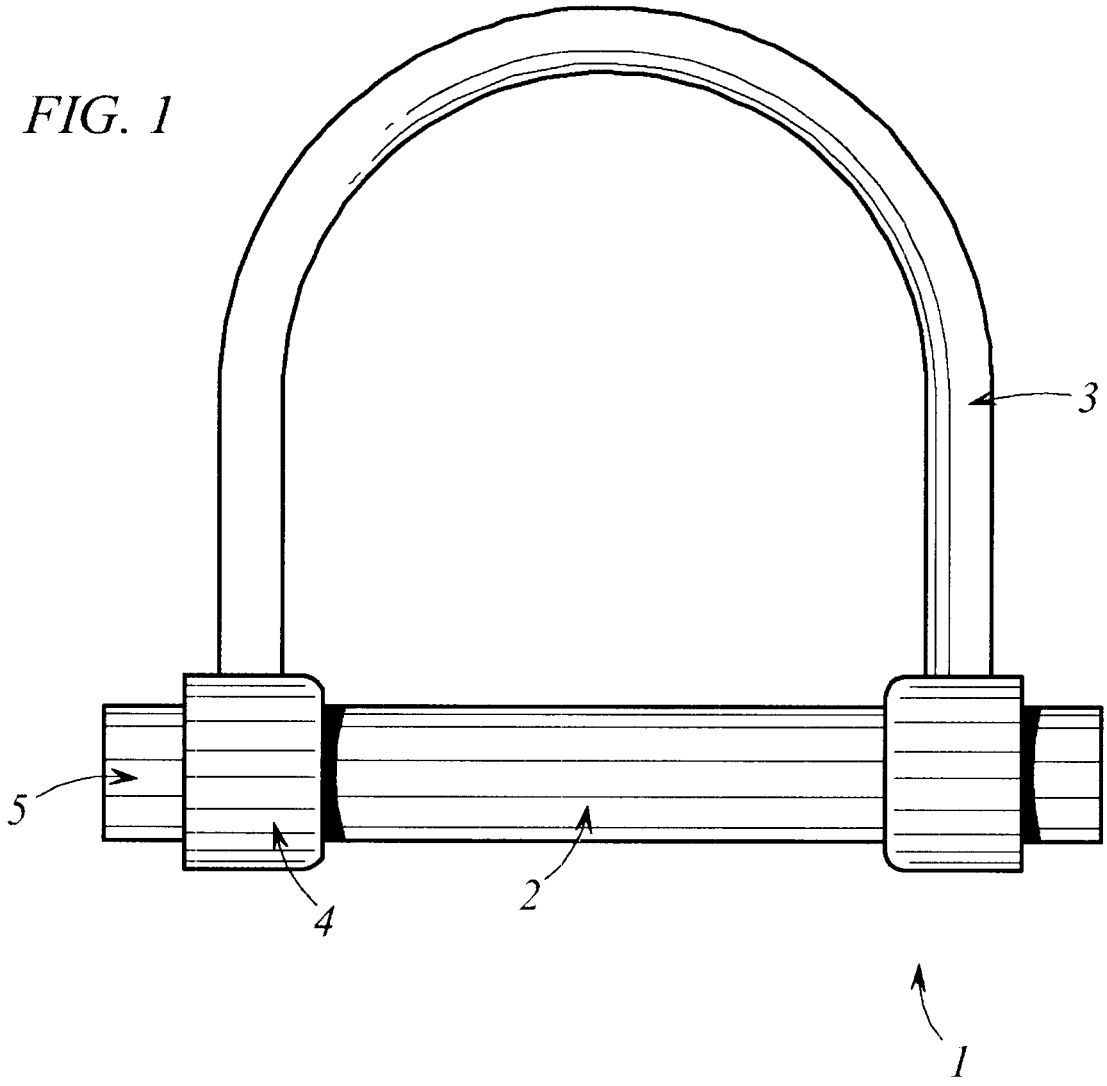
FIG. 1 illustrates a side view of the dumbbell.

Shown in FIG. 1, is the dumbbell 1 of the present invention. The dumbbell 1 has a center gripping bar 2, which a lifter holds onto while using the dumbbell 1. The center gripping bar 2 is preferably rod shaped and has a circular cross-section. To comfortably fit a lifter's hand, the center gripping bar 2 may have a surface which provides a better grip for the lifter. For example, the surface may be etched or textured. Mounted on each side of the center gripping bar 2 is a transition 4. The transition 4 preferably has a larger cross section than the cross section of the center gripping bar 2. Extending from each transition 4 is a weight bar 5. The weight bar 5 extends from each transition 4 linear to the center gripping bar 2. The weight bar 5 preferably has a circular cross section so as to allow circular weights with a hole in the center to be removably engaged or slid onto and off of the weight bar 5. The weight bars 5 may vary in length depending on the number and sizes of weights to be added to the weight bar 5. The cross section of the weight bar 5 is smaller than the cross section of the transition 4. Thus, the transition 4 acts as a stop, preventing the added weights from sliding onto the center gripping bar 2. Because most weights have a uniform center hole size of about 1 inch diameter, the cross-sectional diameter of the weight bar 5 is preferably at least 1 inch. However, the cross-sectional diameter of the weight bar 5 may be adapted to weights with different sized center holes. Also mounted on the transition 4 is a handle 3. The handle 3 is preferably U-shaped, with one end of the U mounted on one transition 4 and the other end of the U mounted on the second transition 4. The U-shaped handle 3 preferably has two straight ends of at least 3 inches, which then extend to form a half-circle with at least a radius of 2.5 inches. This gives a distance from the center gripping bar 2 to the peak of the U-shaped handle 3 of at least 5.5 inches. However, the dimension of the U-shaped handle 3 may vary provided that the handle allows a lifter to grip the center bar while leaving sufficiently extra space above his or her hand to insert the hook 10 found on the weight bench without squeezing or pinching his or her hand between the hook 10, the center gripping bar 2 and the handle 3.

Figure 2:
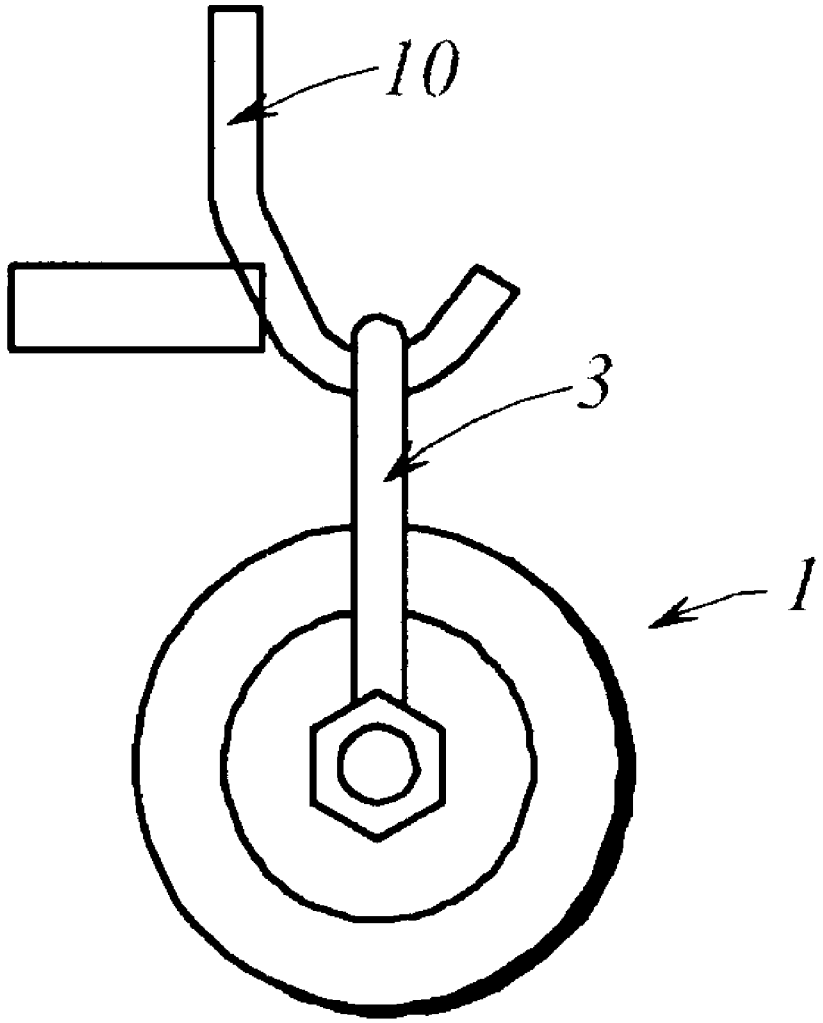
FIG. 2 illustrates the hook from the side view whereby the dumbbell will self-center on the hook.
Figure 3:
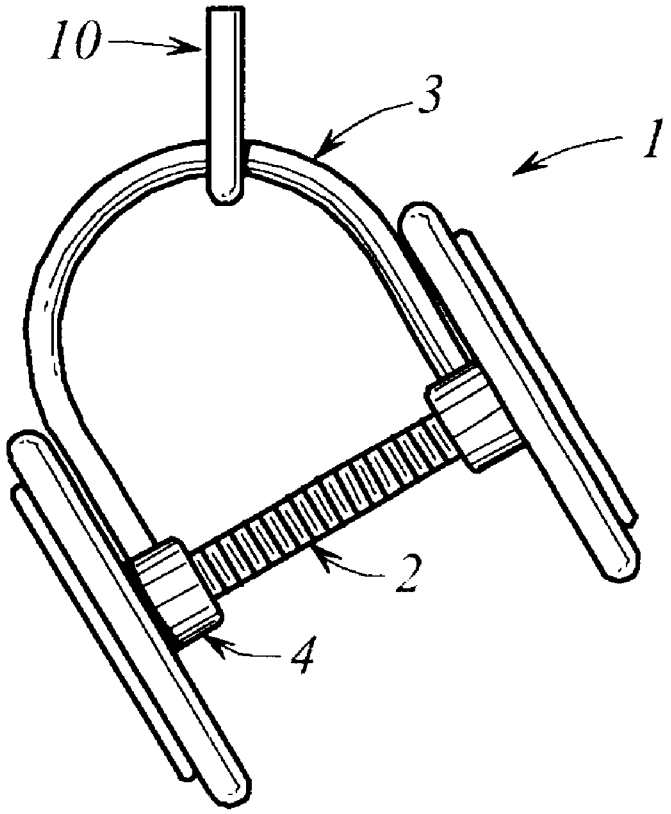
FIG. 3 illustrates the hook from the front view whereby the dumbbell will self-center on the hook.

FIG. 2 and 3 illustrates the U-shaped handle 3 and hook 10, catch feature. Because of the hook's shape and the handle's shape, only one hook 10 is needed to hold each dumbbell 1. The exhausted lifter may make contact between the handle 3 and the hook 10 at any point on the handle 3 or at any point on the hook 10. Then the lifter may release the grip off of the center gripping bar 2 and the dumbbell 1 will self-center on the hook 10 due to its design and the design of the handle. The handle is designed such that it has a peak aligned directly above the dumbbell's center of gravity. The peak lies along the line perpendicular to the center gripping bar 2 at its peak point. Because the weighted ends of dumbbells are typically equally weighted, the peak of the handle is directly aligned with the dumbbell's center of gravity. The peak of the handle is, thus, the dumbbell's equilibrium hanging position. As a result, when the dumbbell is placed on the curved hook, the dumbbell automatically comes to rest at its equilibrium position. Likewise, the hook, as shown in FIGS. 2 and 3 is curved in a J-like shape, and has an equilibrium point at the bottom of the curve. Thus, when the dumbbell is placed by its handle on the hook, it comes to rest at the bottom of the curve at equilibrium and cannot be disengaged from that point without lifting action by a person.

While the present invention has been described in detail, it will be readily appreciated to those skilled in the art that modifications and variations in addition to those mentioned above may be made without departing from the scope and spirit of the invention. Such modifications are to be considered as included in the following claims.

I claim:

1. Weight lifting apparatus entirely made of steel or iron comprising:

a hook;

a dumbbell having a center gripping bar and two weighted ends and having a U-shaped handle, said handle having two straight sides with lengths of at least 3 inches, which emerge in an upward direction from said center gripping bar each from a point equidistant from each of said weighted ends of said center gripping bar and which straight sides meet to form a half-circle with at least a radius of 2.5 inches;

said U-shaped handle of said dumbbell is used to removably suspend said dumbbell from said hook;

said center gripping bar being rod-shaped;

said center gripping bar having two transitions, one mounted on each end of said center gripping bar;

said two transitions mounted on each end of said center gripping bar at a point equidistant from a bisecting plane passing through a center of said center gripping bar;

a weight bar extending from each said transition, which is collinear to said center gripping bar;

said U-shaped handle extending continuously from one of said transition to the second of said transition; and said U-shaped handle having a curved portion peaking at a point which is displaced from the center of said center gripping bar.

2. The apparatus as claimed in claim 1 wherein said transition has a cross section larger than said weight bar and in the bisecting plane.

3. The apparatus as claimed in claim 1 wherein said transition has a cross-section larger than said center gripping bar.

4. The apparatus as claimed in claim 1 wherein said center gripping bar has a cross-sectional diameter of at least 1 inch.

5. The apparatus as claimed in claim 1 wherein said weight bar has a cross-sectional diameter of at least 1 inch.

6. The apparatus as claimed in claim 1 wherein said hook is shaped and sloped so as to suspend said dumbbell in only one centered position.

7. The apparatus as claimed in claim 1 wherein said hook is J-shaped and sloped so as to receive the U-shaped handle of said dumbbell at any point on the said curved portion of said handle and to bring to center the dumbbell when resting within the hook;

said hook being shaped so that said dumbbell may swing on said hook but will not become disengaged without the lifting action of a person.

* * * * *